US011825873B2

(12) United States Patent
Liu

(10) Patent No.: US 11,825,873 B2
(45) Date of Patent: Nov. 28, 2023

(54) HOOKAH

(71) Applicant: Shenzhen Eigate Technology Co., Ltd., Shenzhen (CN)

(72) Inventor: Tuanfang Liu, Shenzhen (CN)

(73) Assignee: ASPIRE NORTH AMERICA LLC

( * ) Notice: Subject to any disclaimer, the term of this patent is extended or adjusted under 35 U.S.C. 154(b) by 433 days.

(21) Appl. No.: 17/096,988

(22) Filed: Nov. 13, 2020

(65) Prior Publication Data

US 2021/0274837 A1 Sep. 9, 2021

(30) Foreign Application Priority Data

Mar. 9, 2020 (CN) ..... 202010159628.1
Mar. 9, 2020 (CN) ..... 202020281437.8

(51) Int. Cl.

| | |
|---|---|
| ***A24F 1/30*** | (2006.01) |
| ***A24F 40/48*** | (2020.01) |
| ***A24F 40/465*** | (2020.01) |
| ***A24F 40/20*** | (2020.01) |
| ***A24F 40/57*** | (2020.01) |
| ***A24F 40/51*** | (2020.01) |
| ***A24F 1/32*** | (2006.01) |

(Continued)

(52) U.S. Cl.

CPC ..... *A24F 1/30* (2013.01); *A24F 1/32* (2013.01); *A24F 40/20* (2020.01); *A24F 40/465* (2020.01); *A24F 40/48* (2020.01); *A24F 40/51* (2020.01); *A24F 40/57* (2020.01); *H05B 6/105* (2013.01); *H05B 6/06* (2013.01)

(58) Field of Classification Search

CPC ..... A24F 1/30

See application file for complete search history.

(56) References Cited

U.S. PATENT DOCUMENTS 6,453,908 B1 * 9/2002 Caballero ..... A24F 1/30 131/200
9,986,769 B1 * 6/2018 Liu ..... A24F 40/40

(Continued)

FOREIGN PATENT DOCUMENTS

| | | | | |
|---|---|---|---|---|
| CN | 107150547 A | * | 9/2017 | |
| DE | 102016122558 A1 | * | 5/2018 | ..... A47J 37/0709 |
| WO | WO 2020/149821 A1 | * | 7/2020 | ..... A24F 47/00 |

OTHER PUBLICATIONS

Koektuerk, 'Heater Assembly' English Translation, Jan. 2023, European Patent Office (Year: 2023).*

(Continued)

*Primary Examiner* — Philip Y Louie
*Assistant Examiner* — Caitlin Elise Brown
(74) *Attorney, Agent, or Firm* — MATTHIAS SCHOLL P.C.; Matthias Scholl

(57) ABSTRACT

A hookah, including a high-frequency heating component and a filter assembly. The high-frequency heating component includes a conductive cup and a magnetic induction coil. The conductive cup is disposed in the magnetic induction coil and configured to accommodate a tobacco material. When in use, an alternating current is introduced to the magnetic induction coil, and a magnetic induction effect is generated, so that the conductive cup is heated and the heat is transferred to the tobacco material whereby the tobacco material is heated and smoke is produced. The smoke is filtered in the filter assembly and inhaled by a user.

7 Claims, 5 Drawing Sheets

(51) Int. Cl.
*H05B 6/06* (2006.01)
*H05B 6/10* (2006.01)

(56) References Cited

U.S. PATENT DOCUMENTS 10,477,891 B1 * 11/2019 Robertson ..... A24F 1/06
2017/0251718 A1 * 9/2017 Armoush ..... A24F 1/30

OTHER PUBLICATIONS

Li, 'Manufacturing method for inlaying metal in glass' English Translation, Feb. 2023, European Patent Office (Year: 2023).*
Six Flags Entertainment Corporation, 2013 Refillable Water Bottle Merchandise—Worthpoint Advertisement, Feb. 2023, Worthpoint.com (Year: 2023).*

* cited by examiner

HOOKAH

CROSS-REFERENCE TO RELATED APPLICATIONS

Pursuant to 35 U.S.C. § 119 and the Paris Convention Treaty, this application claims foreign priority to Chinese Patent Application No. 202010159628.1 filed Mar. 9, 2020, and to Chinese Patent Application No. 202020281437.8 filed Mar. 9, 2020; the contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, MA 02142.

BACKGROUND

The disclosure relates to a hookah.

A conventional hookah is ignited by open fire and contains no over-temperature protection unit. When the burning temperature of the hookah exceeds a critical value, the components of the hookah may be burnt out.

SUMMARY

The disclosure provides a hookah, comprising a high-frequency heating component and a filter assembly; wherein the high-frequency heating component comprises a conductive cup and a magnetic induction coil; the conductive cup is disposed in the magnetic induction coil and configured to accommodate a tobacco material; when in use, an alternating current is introduced to the magnetic induction coil, and a magnetic induction effect is generated, so that the conductive cup is heated and the heat is transferred to the tobacco material whereby the tobacco material is heated and smoke is produced; the smoke is filtered in the filter assembly and inhaled by a user.

In a class of this embodiment, the hookah comprises a body, and the conductive cup and the magnetic induction coil are disposed in one side of the body.

In a class of this embodiment, the hookah further comprises a ceramic cup disposed between the conductive cup and the magnetic induction coil.

In a class of this embodiment, the filter assembly comprises a straight glass tube, an adapter, a curved glass tube, and a snuff bottle; the smoke enters the snuff bottle via the adapter and curved glass tube, and is discharged from the straight glass tube.

In a class of this embodiment, the conductive cup is a glass cup with an inlayed metal.

In a class of this embodiment, the smoke flows in a space between the conductive cup and the ceramic cup and through a bottom opening of the ceramic cup into an inner space of the adapter.

In a class of this embodiment, the hookah further comprises a temperate sensor; when a temperature of the hookah reaches a set maximum temperature, the temperate sensor transmits a temperature signal to an over-temperature protection circuit of a control panel and the control panel reduces an output power of the hookah.

In a class of this embodiment, the temperature sensor is disposed on a bottom of the ceramic cup.

In a class of this embodiment, the hookah further comprises an air guide cover; the air guide cover comprises a hollow part with a first opening and a second opening smaller than the first opening; and the second opening is disposed in the conductive cup.

In a class of this embodiment, the air guide cover is a ceramic.

In a class of this embodiment, the hookah further comprises an air guide tube and an airflow sensor; the air guide tube is disposed on the adapter for air conduction; the airflow sensor is disposed on the air guide tube; when an airflow passes through the air guide tube, the airflow sensor triggers the high-frequency heating component to work.

In a class of this embodiment, the hookah further comprises a mouthpiece; the mouthpiece is a hollow hemispherical glass structure comprising an opening.

DETAILED DESCRIPTION

Figure 1:
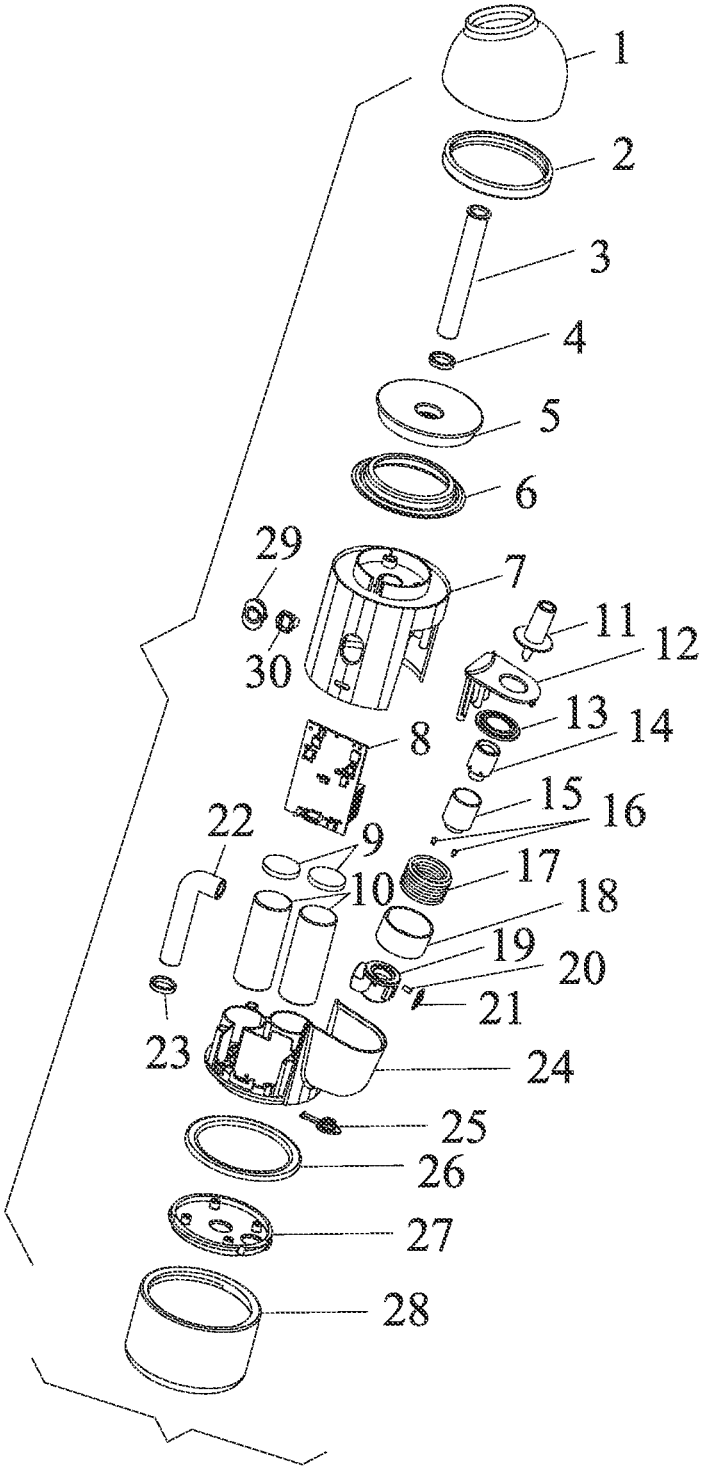
FIG. 1 is an exploded view of a hookah in accordance with one embodiment of the disclosure.
Figure 2:
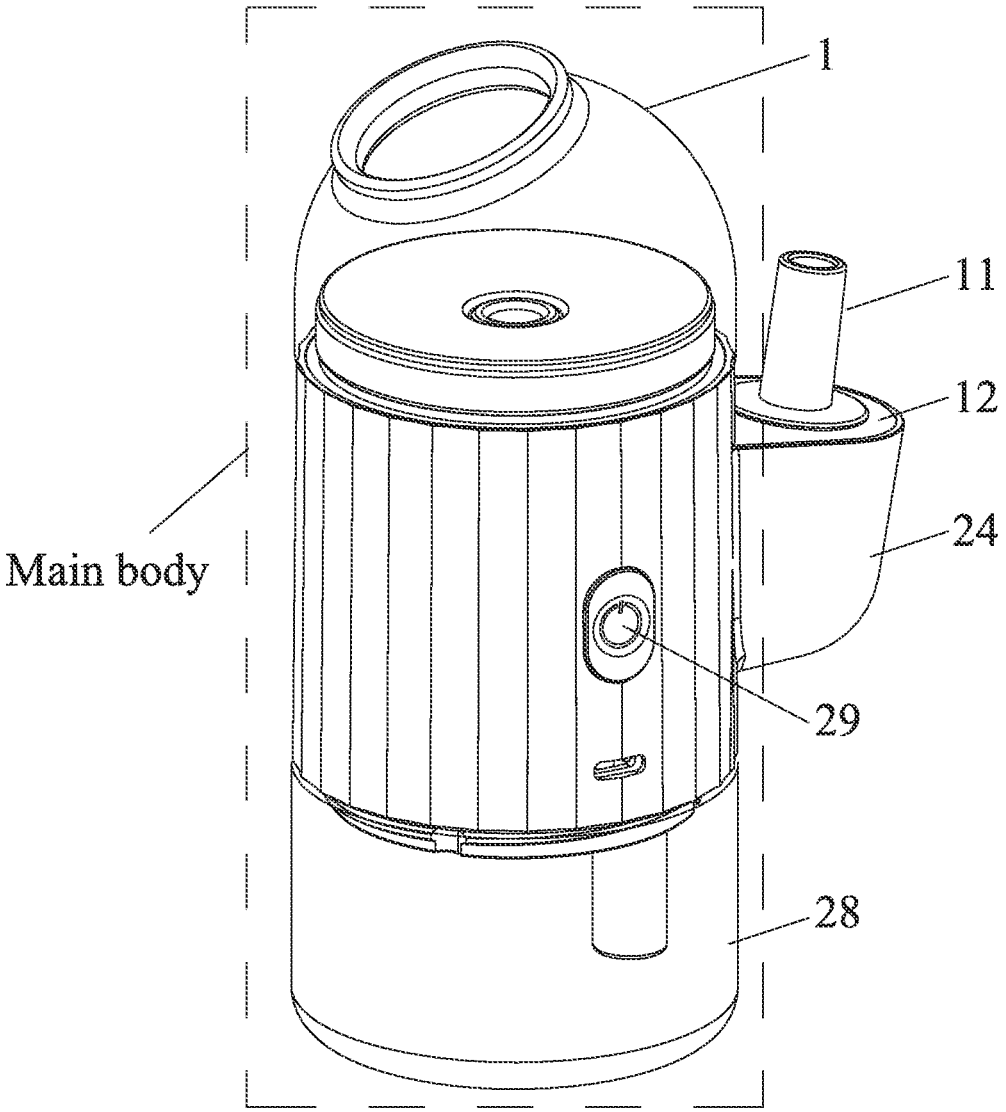
FIG. 2 is a schematic diagram of a hookah in accordance with one embodiment of the disclosure.
Figure 3:
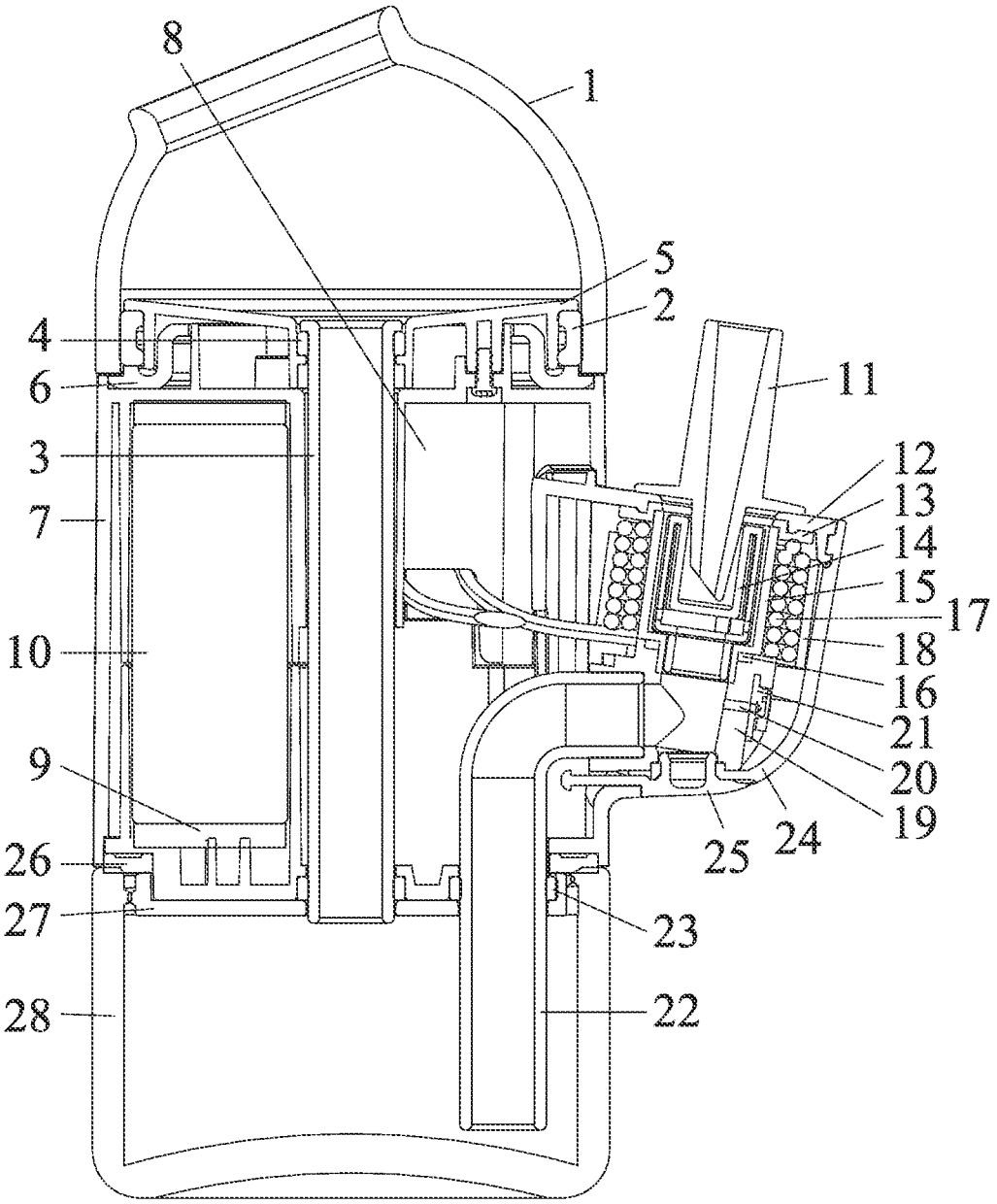
FIG. 3 is a sectional view of a hookah in accordance with one embodiment of the disclosure.

To further illustrate the disclosure, embodiments detailing a hookah are described below. It should be noted that the following embodiments are intended to describe and not to limit the disclosure.

Principle of high frequency heating: when an alternating current is introduced to a magnetic induction coil, an alternating magnetic field will be generated. When a metal conductor is placed in the alternating magnetic field, an eddy current is produced. The eddy current makes the metal conductor heated.

Tobacco materials refer to smoke oil, tobacco and other materials used to produce smoke.

The conductive cup of the disclosure can be made of metal material, or part of the cup is made of metal material, or the cup is made of nonmetal material inlaid with metal material.

Specifically, as shown in FIGS. 1-5, the disclosure provides a hookah comprising a mouthpiece 1, a first seal ring 2, a straight glass tube 3, a second seal ring 4, an end cover 5, a light guide ring 6, a housing 7, a control panel 8, an ethylene vinyl acetate (EVA) gasket 9, a battery 10, an air guide cover 11, a cover plate 12, a third seal ring 13, a conductive cup 14, a ceramic cup 15, a temperature sensor 16, a magnetic induction coil 17, a strip of cotton 18, an adapter 19, an air guide tube 20, an airflow sensor 21, a curved glass tube 22, a fourth seal ring 23, a bottom casing 24, a rubber plug 25, a fifth seal ring 26, a bottle cover 27, a snuff bottle 28, a button 29, and a silica gasket 30. The positive and negative terminals of the battery 10 are soldered to the input end of the control panel to supply power to the control panel 8. The ethylene vinyl acetate (EVA) gasket 9 is attached to the positive and negative terminals of the battery 10 to insulate the battery. The output end of the control panel 8 is fixed to the input end of the magnetic induction coil 17 to supply power to the magnetic induction coil 17. The conductive cup 14 is configured to accommodate the tobacco material. The conductive cup 14 is disposed in the ceramic cup 15. The ceramic cup 15 is disposed in the magnetic induction coil 17 to fix the conductive cup 14 and to separate the conductive cup 14 from the magnetic induction coil 17. The temperature sensor 16 is disposed on the bottom of the ceramic cup 15 and is used for over-temperature protection when the temperature of the conductive cup 14 reaches a set maximum temperature. The third seal ring 13 is disposed on the ceramic cup 15 to seal the smoke produced by heating the tobacco material. The strip of cotton 18 is wrapped around the magnetic induction coil 17 for thermal insulation. The air guide tube 20 is disposed on the adapter 19 for air conduction. The airflow sensor 21 is disposed on the air guide tube 20. The conductive cup 14 and the magnetic induction coil 17 form a high-frequency heating component. When the air flow passes through the air guide tube 20, the airflow sensor 21 triggers the high-frequency heating component to work. The adapter 19 is installed in the bottom casing 24 to receive the curved glass tube 22, and the curved glass tube 22 penetrates the bottom casing 24 and is connected to the adapter 19. The rubber plug 25 is disposed on the bottom casing 24 thus preventing the air leakage from the bottom casing. The magnetic induction coil 17 is fixed on an inner side of the bottom casing 24. The cover plate 12 is disposed on one side of the bottom casing 24 to protect the magnetic induction coil 17. The air guide cover 11 is disposed on the cover plate 12 for air inlet. The button 29 and the silica gasket 30 are disposed on the switch button of the control panel 8. The battery 10 and the control panel 8 are disposed in the bottom casing 24. The fifth seal ring 26 is disposed on the bottom of the bottom casing 24 to seal the snuff bottle 28. The fourth seal ring 23 is disposed on the bottle cover 27 to seal the curved glass tube 22. The bottle cover 27 is disposed on the snuff bottle 28 for sealing the snuff bottle 28. The snuff bottle 28 is disposed on the bottom of the bottom casing 24. The curved glass tube 22 passes through the bottle cover 27 and one end of the curved glass tube is inserted below the liquid level in the snuff bottle 28 to filter the smoke entering the snuff bottle via the curved glass tube through the water. The straight glass tube 3 passes through the center of the bottom casing 24, and one end of the straight glass tube 3 is suspended above the liquid level in the snuff bottle 28, so that the filtered smoke through the water diffuses into the one end of the straight glass tube and is discharged from the other end of the straight glass tube. The light guide ring 6 is disposed on the end cover 5, and the end cover 5 is disposed on the housing 7. When the airflow sensor works, the light guide ring is lighted up. The second seal ring 4 is disposed on the straight glass tube 3. The housing 7 is disposed on the bottom casing 24 and the straight glass tube 3 is disposed in the center of the housing 7. The first seal ring 2 is disposed on the end cover 5 to seal the mouthpiece 1. The mouthpiece 1 is disposed on the end cover 5 and is connected to the straight glass tube 3. The filtered smoke passes through the straight glass tube 3 and enters the mouthpiece for user's inhaling.

The air guide cover 11 comprises a plurality of holes. When in use, part of the holes can be covered by user's fingers, and thus the area of the holes is adjustable to control the airflow volume. The air guide cover 11 is made of ceramic material with heat insulation properties. The design can protect the user's fingers from being burned.

Figure 4:
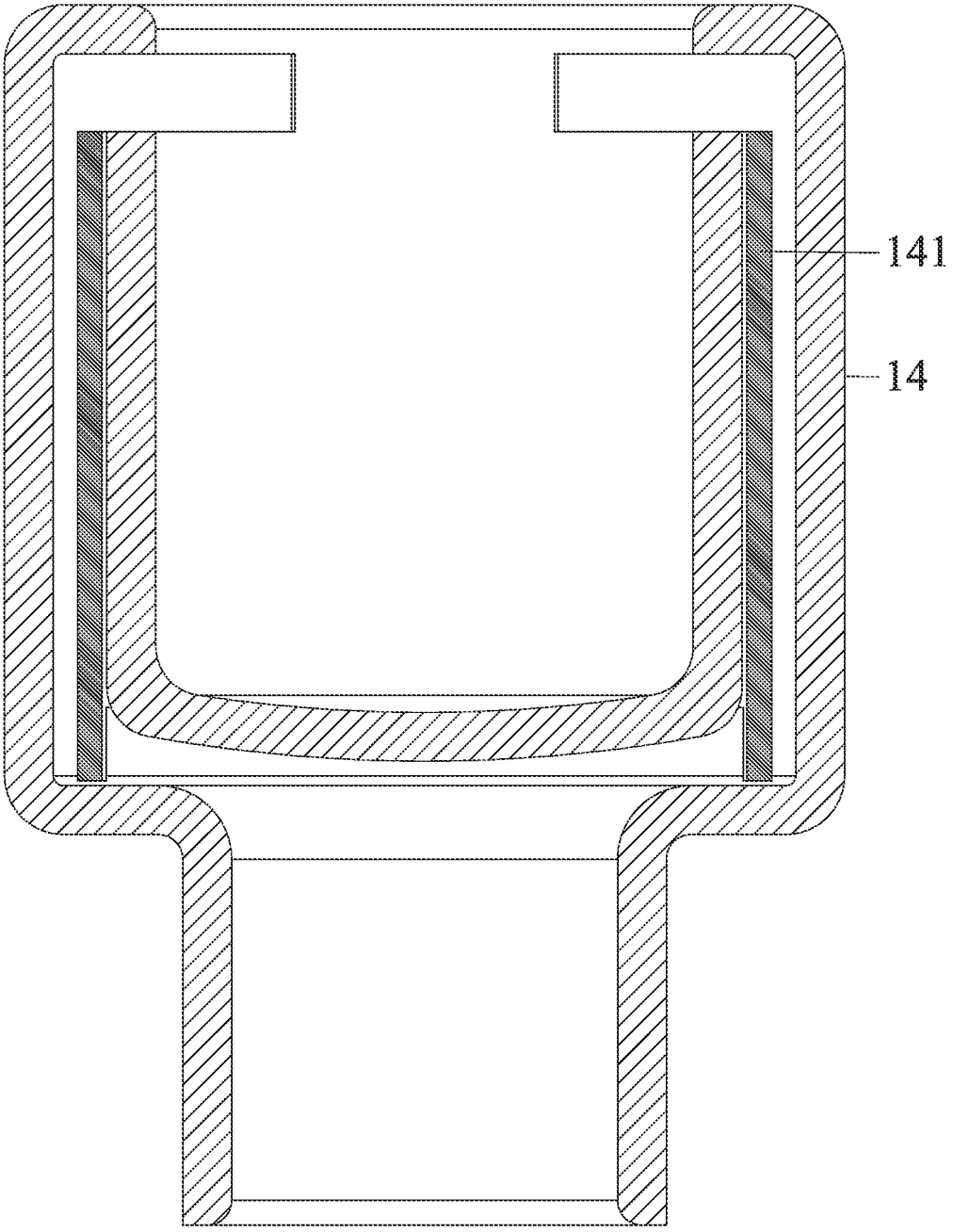
FIG. 4 is a sectional view of a conductive cup of a hookah in accordance with one embodiment of the disclosure.
Figure 5:
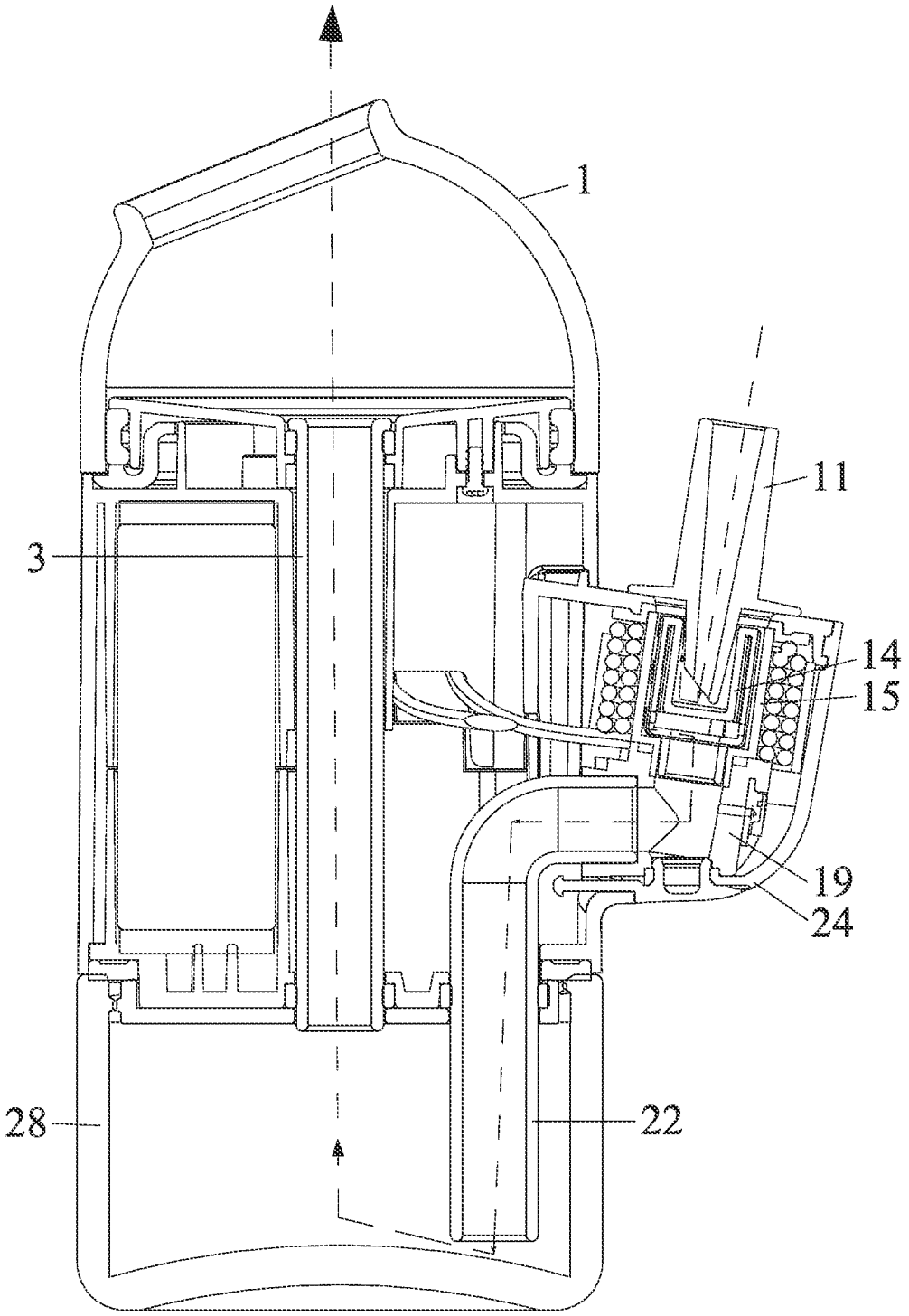
FIG. 5 shows a flow direction of a hookah in accordance with one embodiment of the disclosure.

As shown in FIG. 4, the conductive cup 14 comprises a metal 141.

The air guide tube 20 is used for air conduction and driving the airflow sensor 21 to work. The control panel comprises a pneumatic switch and a button switch. Upon smoking, the air enters the airflow sensor 21 via the air guide tube 20 and drives the airflow sensor 21 to work and the high-frequency heating component produces heat. Optionally, the high-frequency heating component can be driven to work by pressing the pneumatic switch. The air guide tube 20 is used for air conduction and prevents the fluid material generated by heating from flowing into the airflow sensor 21 so that the airflow sensor does not work.

The following advantages are associated with the hookah of the disclosure:

1. The hookah comprises the high-frequency heating component, and the tobacco material placed in the conductive cup can be heated through the electromagnetic induction principle of the magnetic induction coil.
2. The hookah comprises the snuff bottle which can filter the produced smoke.
3. The hookah comprises the temperature sensor, thus having the over-temperature protection function.

It will be obvious to those skilled in the art that changes and modifications may be made, and therefore, the aim in the appended claims is to cover all such changes and modifications.

The invention claimed is:

1. A hookah, comprising a body, a ceramic cup, a high-frequency heating component, and a filter assembly; wherein:

the high-frequency heating component comprises a conductive cup and a magnetic induction coil;

the conductive cup is disposed in the magnetic induction coil and configured to accommodate a tobacco material;

when in use, an alternating current is introduced to the magnetic induction coil, and a magnetic induction effect is generated, so that the conductive cup is heated and the heat is transferred to the tobacco material whereby the tobacco material is heated and smoke is produced; the smoke is filtered in the filter assembly and inhaled by a user;

the conductive cup and the magnetic induction coil are disposed in one side of the body;

the ceramic cup is disposed between the conductive cup and the magnetic induction coil;

the filter assembly comprises a straight glass tube, an adapter, a curved glass tube, and a snuff bottle; the snuff bottle is adapted to receive the smoke via the adapter and curved glass tube, and the snuff bottle is adapted to discharge the smoke via the straight glass tube; and the conductive cup is a glass cup with an inlaid metal; and a space between the conductive cup and the ceramic cup is adapted to convey the smoke through a bottom opening of the ceramic cup into an inner space of the adapter.

2. The hookah of claim 1, wherein the hookah further comprises a temperate sensor; when a temperature of the hookah reaches a set maximum temperature, the temperate sensor transmits a temperature signal to an over-temperature protection circuit of a control panel and the control panel reduces an output power of the hookah.

3. The hookah of claim 2, wherein the temperature sensor is disposed on a bottom of the ceramic cup.

4. The hookah of claim 1, wherein the hookah further comprises an air guide cover; the air guide cover comprises a hollow part with a first opening and a second opening smaller than the first opening; and the second opening is disposed in the conductive cup.

5. The hookah of claim 4, wherein the air guide cover is a ceramic.

6. The hookah of claim 1, wherein the hookah further comprises an air guide tube and an airflow sensor; the air guide tube is disposed on the adapter for air conduction; the airflow sensor is disposed on the air guide tube; when an airflow passes through the air guide tube, the airflow sensor triggers the high-frequency heating component to work.

7. The hookah of claim 1, wherein the hookah further comprises a mouthpiece; the mouthpiece is a hollow hemispherical glass structure comprising an opening.

* * * * *